United States Patent [19]

Eckel

[11] 4,082,017

[45] Apr. 4, 1978

[54] POWER OPERATED DRILL PIPE TONGS

[75] Inventor: Emery Eckel, Odessa, Tex.

[73] Assignee: Eckel Manufacturing Co., Odessa, Tex.

[21] Appl. No.: 728,062

[22] Filed: Sep. 30, 1976

Related U.S. Application Data

[63] Continuation-in-part of Ser. No. 539,078, Jan. 7, 1975, abandoned.

[51] Int. Cl.[2] ..... B25B 17/00

[52] U.S. Cl. ..... 81/57.16; 81/57.19; 81/57.34

[58] Field of Search ..... 81/54, 57.33–57.36, 81/57.19; 269/25, 126, 127; 294/88, 90

[56] References Cited

U.S. PATENT DOCUMENTS

| | | | |
|---|---|---|---|
| 2,705,614 | 4/1955 | McKibben et al. | 269/25 |
| 2,724,201 | 11/1955 | Calvalero | 269/25 |
| 3,629,927 | 12/1971 | Palmer | 29/240 |
| 3,760,658 | 9/1973 | Guier | 81/57.34 |
| 3,799,009 | 3/1974 | Guier | 81/57.16 |

*Primary Examiner*—James L. Jones, Jr.
*Attorney, Agent, or Firm*—Fleit & Jacobson

[57] ABSTRACT

Hydraulically or pneumatically powered drill pipe tongs of the scissors-type used in making up or breaking apart joints of drill pipe, drill collars and the like including an upper tong and a lower tong each including tong die heads for biting into or gripping the upper and lower joints of drill pipe, drill collars and the like with the upper and lower tongs being swivelly connected and being swivelled by a hydraulically or pneumatically powered torqueing piston and cylinder assembly for rotating the upper and lower tongs in relation to each other when making up or breaking apart the drill pipe joints. Each of the upper and lower tongs includes a sliding door having one of the tong die heads thereon that can be moved a substantial distance toward and away from the tong body by the use of a pair of hydraulically or pneumatically powered piston and cylinder assemblies to enable tool joints, drill pipe protectors and the like to pass through the tongs while leaving the tongs on the pipe. Each of the tongs also includes a hinged mounting for one edge portion of the tong door and a latch for the other edge portion to enable the tong door to be latched or unlatched and swung outwardly in a manner to enable the tongs to be removed from the drill pipe when necessary.

36 Claims, 15 Drawing Figures

Fig. 8B
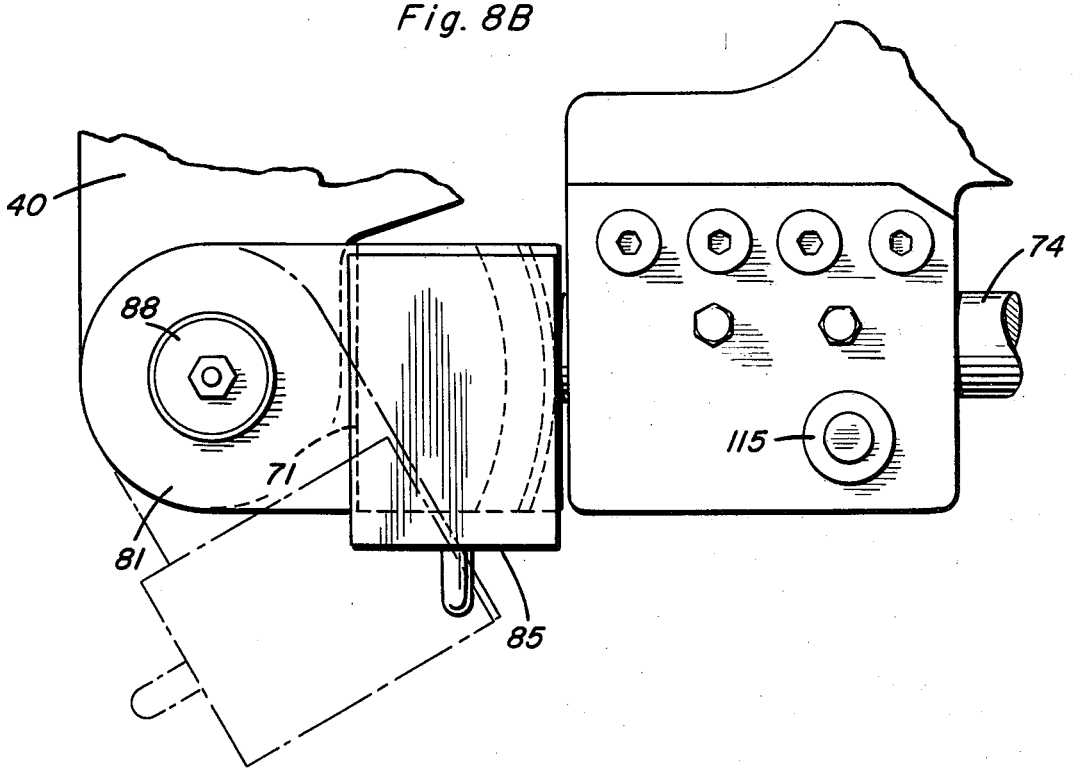
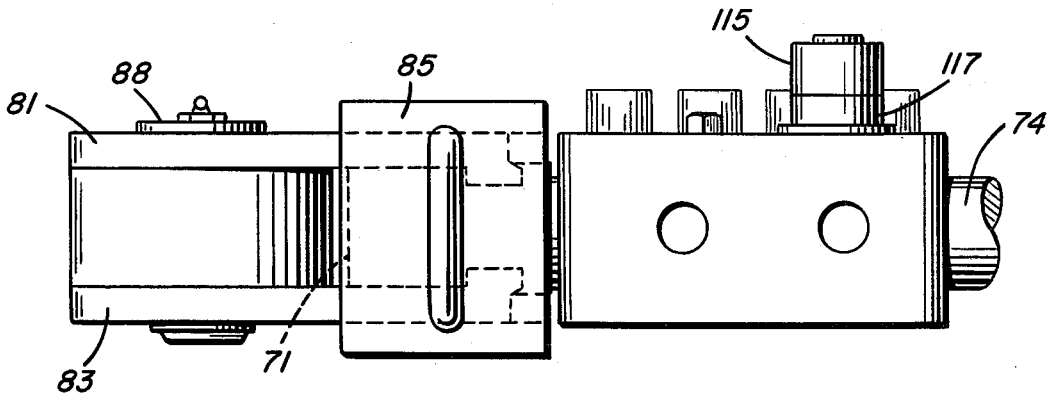
Fig. 8C 256
228
252
230
226
202
210
208
248
204
210
208
250
206
208
207
240
248
238

200
244
232
210
242
208
234
224
212
214

POWER OPERATED DRILL PIPE TONGS

CROSS-REFERENCE TO RELATED APPLICATION

This is a continuation-in-part of Ser. No. 539,078, filed Jan. 7, 1975, now abandoned.

BACKGROUND OF THE INVENTION

1. Field of the Invention

The present invention generally relates to drill pipe tongs used in making up or breaking apart drill pipe joints and includes hydraulically or pneumatically powered upper and lower tongs which are swivelly connected for a scissoring action. Each of the tongs includes a door that is hingedly mounted at one edge and provided with a latch at the other edge to enable the doors to be swung to a completely open position for removal of the tongs from the drill pipe when desired.

2. Description of the Prior Art

Various types of tongs have been employed when making up or breaking out drill pipe joints, drill collars and the like in oil well drilling operations in which upper and lower tongs sequentially grip and release upper and lower drill pipe joints with the upper and lower tongs being moved in a swivelling or scissoring manner to thread or unthread the threaded connection between the drill pipe joints. Power operated tongs have been provided for this purpose and the following U.S. patents disclose some of the developments that have occurred in this field of endeavor:

U.S. Pat. No. 2,668,689
U.S. Pat. No. 2,737,839
U.S. Pat. No. 2,760,392
U.S. Pat. No. 2,871,743
U.S. Pat. No. 3,021,739
U.S. Pat. No. 3,316,783
U.S. Pat. No. 3,629,927
U.S. Pat. No. 3,799,009

In addition to the above-listed patents, a hydraulically actuated drill pipe tong is being manufactured in which an upper and lower tong are swivelled with respect to each other by a torqueing cylinder which can be extended or retracted to break out or make up the drill pipe as may be required. The pipe biting or gripping system utilizes a centrally-positioned single hydraulic ram which extends to move one of two opposed tong die heads into gripping or biting engagement with the pipe so as to grip the pipe for making up or breaking the joint. This tong includes a pivotally mounted latching door which can be released and pivoted to an open condition so that the tongs can be removed from the pipe. Since the opening or space provided by the gripping system of this prior tong through which the drill pipe passes when operating on pipe stands is not sufficient to permit tool joints, protectors and the like to pass, it is necessary to continuously open the latching door. This opening of the door and subsequent closing and latching of the door is a relatively time-consuming operation when running stands of drill pipe. In other words, the limited movement of the tong die head between its biting or gripping position and its released position is of such small dimension that the pipe, protectors thereon and the like are precluded from passing through the tongs unless the door is opened.

SUMMARY OF THE INVENTION

An object of the present invention is to provide power actuated tongs for making up or breaking apart joints or drill pipe, drill collars and the like in which the pipe gripping die heads in the tongs can be moved apart a sufficient distance to enable drill collar joints and rubber drill pipe protectors and the like thereon to pass through the tongs without requiring the tong door to be unlatched, swung to an open position, closed and then relatched thereby greatly reducing the time required to make up or break out drill pipe collars and the like inasmuch as the pipe joints do not have to be removed therefrom.

Another object of the invention is to provide power operated tongs in which the tong door is mounted for movement between a pipe joint gripping and releasing position by a pair of hydraulically or pneumatically actuated piston and cylinder assemblies oriented on opposite sides of the passage in the tongs which receives the drill pipe joint with the piston and cylinder assemblies being simultaneously extended and retracted for movement of the tong door and die head thereon toward the tong body and away from the tong body for effectively gripping the drill pipe joint and releasing the drill pipe joint and providing a large dimensioned passage through the tongs so that the drill pipe joints and protectors may pass freely through the tongs without removing the tongs from the drill pipe.

Another object of the invention is to provide a pair of power operated cylinders, one on each side of the line of movement of the gripping die heads, which cylinders retract to move the die heads into gripping relationship with the pipe to thereby produce a better balanced and better supported power mechanism for the tongs to grip the pipe.

Still another object of the invention is to provide a power operated drill pipe tong in accordance with the preceding objects in which the reciprocally mounted tong door is also provided with a hinged or pivotal mounting at one edge thereof and a latch at the opposite edge to enable the door to be swung to an open position when desired for enabling the tongs to be removed from the drill pipe.

A further object of the invention is to provide power operated tongs which may be horizontally and vertically aligned with the drill pipe joint.

Yet a further important object of the invention is to provide hydraulically operated drill pipe tongs which are quite simple and uncomplicated in their structural detail but effective for gripping the drill pipe joint and transmitting torque thereto when the upper and lower tongs are swivelled or scissored in relation to each other so that the tongs will effectively operate for extended periods of time without excessive maintenance or repair.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8B is a fragmental top plan view of the door latch of FIG. 8A with the broken line position illustrating the pivotal movement of the door latch;

FIG. 8C is a fragmental side elevational view of the door latch of FIG. 8A;

DESCRIPTION OF THE PREFERRED EMBODIMENT

Figure 1:
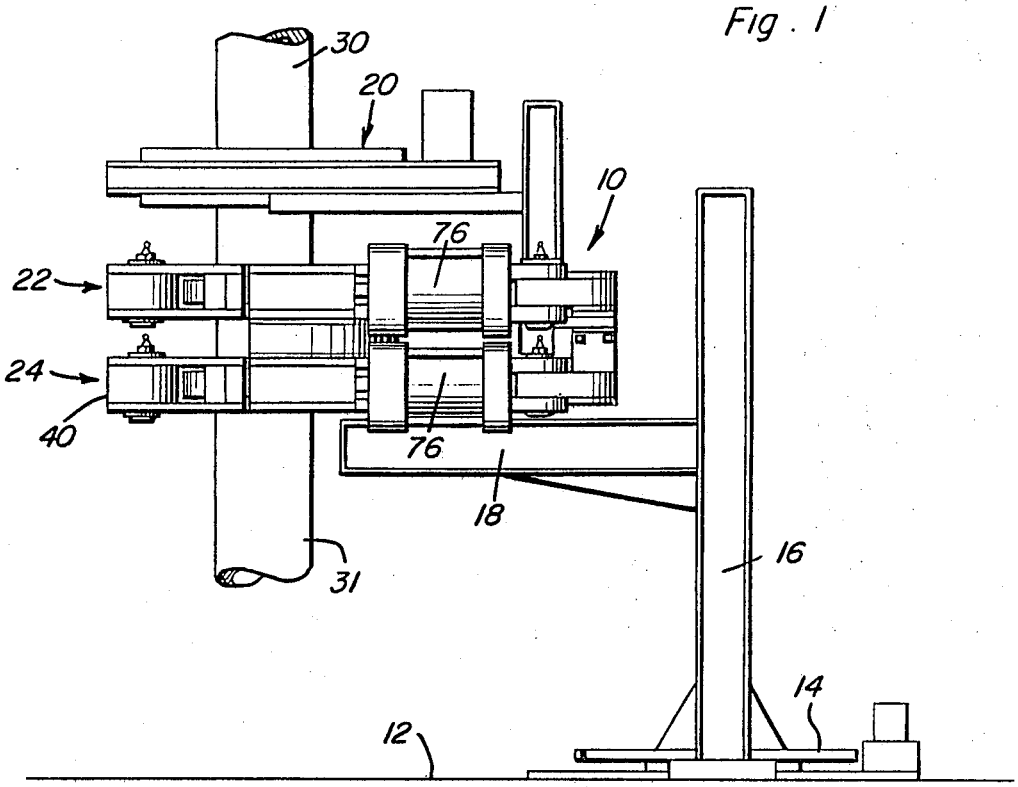
FIG. 1 is a schematic elevational view of the power actuated drill pipe tongs of the present invention illustrating their association with a spinner, supporting pedestal, turntable and drill rig floor.

Referring now specifically to FIG. 1 of the drawings, the preferred power actuated drill pipe tongs of the present invention are generally designated by numeral 10 and illustrated in association with a drill rig floor 12, a supporting turntable 14 and pedestal 16 which includes a laterally extending support member 18 for the tongs. The tongs also are associated with a conventional spinner generally designated by numeral 20 which is located above the tongs for spinning the pipe in the usual manner, the details of the spinner forming no particular part of the present invention. While the invention is hereafter described utilizing hydraulically actuated power cylinders and a hydraulic circuit therefor, it will be readily appreciated and understood by those skilled in the art that any one or all of the power cylinders of this invention can be pneumatic, as well as hydraulic, and a conventional pneumatic circuit used in conjunction therewith.

The hydraulically operated drill pipe tongs 10 include an upper tong 22 and a lower tong 24 each of which is substantially identical and which includes a horizontally disposed body 26 which is provided with a generally U-shaped recess or notch 28 in an edge thereof to receive joints of drill pipe, drill collars and the like 30. Mounted on the body 26 in a recess 32 in the central portion of the notch 28 is a die head 34 having gripping or biting elements 36 mounted thereon with the die head 34 being removably secured in place by a removable pin 38. The die head 34 has an angular surface on which the biting elements 36 are mounted so that the biting elements are oriented on the circumference of the drill pipe joint 30 with the spaced, angular relation enabling the elements 36 to engage spaced points on the circumference of the drill pipe or tool joint.

Figure 2:
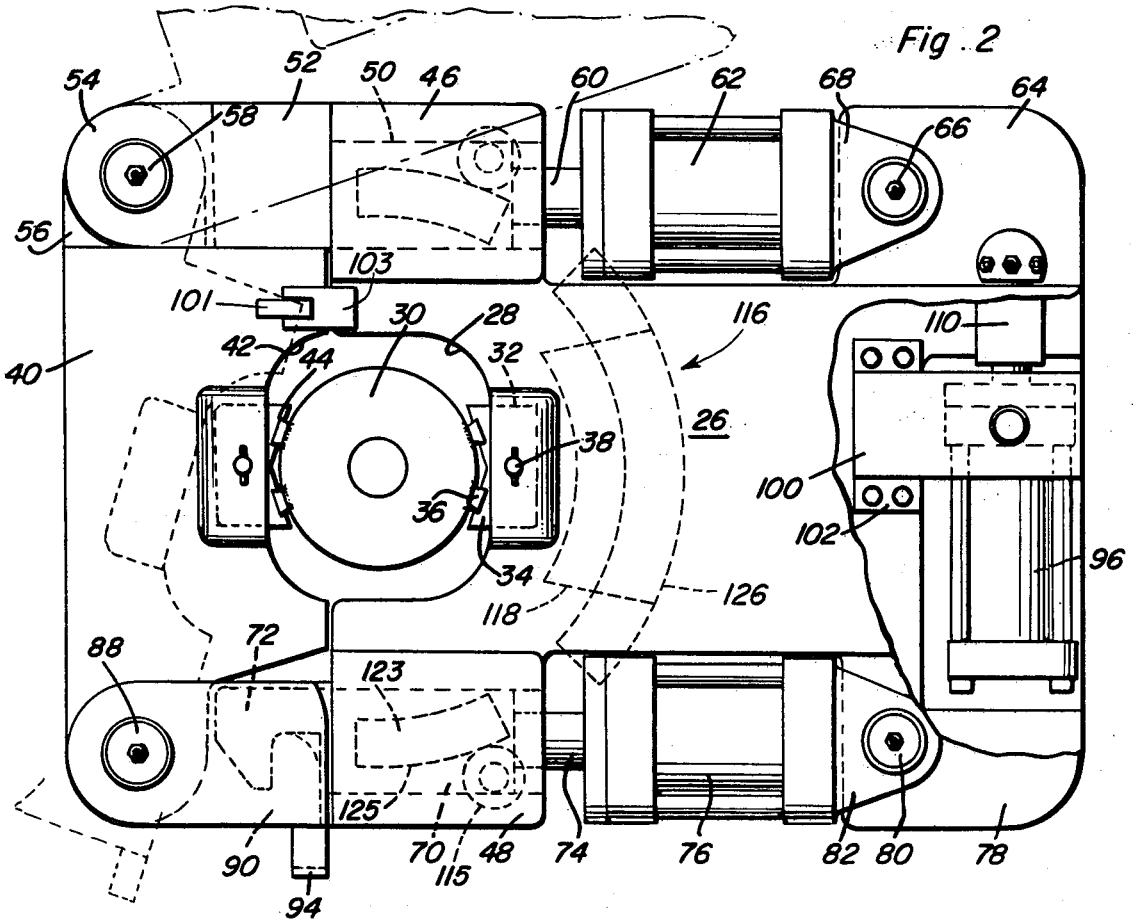
FIG. 2 is a top plan view of the tongs in their gripping or biting position with the broken line position of the tong door illustrating the pivotal movement of the door when opened.

Disposed in opposed relation and generally in alignment with the tong body 26 is a horizontally disposed door 40 which includes a shallow notch or recess 42 in the edge thereof facing the edge of the tong body 26 having the notch or recess 28 therein. A die head 44 is mounted on the door 40 in the recess 42 in opposed relation to the die head 34 for gripping and biting engagement with the drill pipe joint 30 as illustrated in FIG. 2 with the die head 44 being substantially identical to the die head 34.

In order to move the door 40 toward and away from the tong body 26 for releasing the drill pipe joint 30 and enlarging the opening or passage defined by the notches 28 and 42, the tong body is provided with a pair of guides 46 and 48 which are parallel to each other and oriented along opposite side edges of the tong body 26 with the guide 46 slidably receiving and guiding an extension 50 on a hinge slide 52. The slide 52 has a bifurcated end 54 receiving a rounded corner portion 56 of the door 40 therebetween with a hinge pin 58 extending through the bifurcated end of the slide and through the rounded corner and reduced thickness portion of the door 40 thus hingedly securing the door 40 to the slide 52. The other end of the slide 52 is provided with a piston rod 60 rigid with the extension 50 and extending into a double acting hydraulically operated piston and cylinder assembly 62 which is anchored to the tong body 26 by a pin 66 extending through a bifurcated end portion 68 on the piston and cylinder assembly 62 and the corner portion 64 of the tong body 26. Thus, by extending and retracting the piston and cylinder assembly 62, the slide 52, the pin 58, and the corresponding end of the door 40 may be moved toward and away from the tong body 26.

The other guide 48 receives a latch slide 70 therein which includes an outwardly facing hook-shaped member 72 on one end thereof and a piston rod 74 extending from the other end thereof which extends into a piston and cylinder assembly 76 which is double acting and hydraulically actuated and pinned to a corner extension 78 on the tong body 26 by a pin 80 extending through a bifurcated end portion 82 on the piston and cylinder assembly 76 which structure is substantially the same as that on the opposite edge of the tong body 26. Pivotally attached to a rounded corner extension on the door 40, indicated by numeral 84 is a door latch 86 in the form of a bifurcated member that receives the extension 84 therebetween. A pivot pin 88 pivotally interconnects the door latch 86 with the door 40, and the end of the door latch 86 opposite from the hinge pin 88 is provided with a latch member 90 associated with recesses 92 defined between the plates which form the door latch 86. Thus, the hook-shaped member 72 mounted on the latch slide 70 is normally engaged with the latch member 90 on the door latch 86 to maintain the door 40 in closed position with the piston and cylinder assemblies 62 and 76 being operative simultaneously to move the door 40 away from the tong body 26 or toward the tong body 26.

When the door 40 is moved away from the tong body 26, the drill pipe joint 30 and any protectors and the like thereon may move through the enlarged passageway defined by the notches 28 and 42 and the distance between the opposed edges of the door 40 and tong body 26. It has been found that by moving the door 40 away from the tong body 26 approximately four inches, the drill pipe joint, drill collars and protectors thereon may be moved through the tongs 10 without opening door latch 86 or removing the tongs 10 from the drill pipe during make-up or breaking apart operations. However, when it is desired to remove the tongs from the drill pipe, the door latch 86 may be pivoted outwardly by pulling outwardly on lug 94 thereon thereby disengaging the latch member 90 from the hook-shaped latch member 72, and the door 40 then can be swung away from the tong body 26 about the hinge pin 58 as illustrated in broken line in FIG. 2.

Figure 8A:
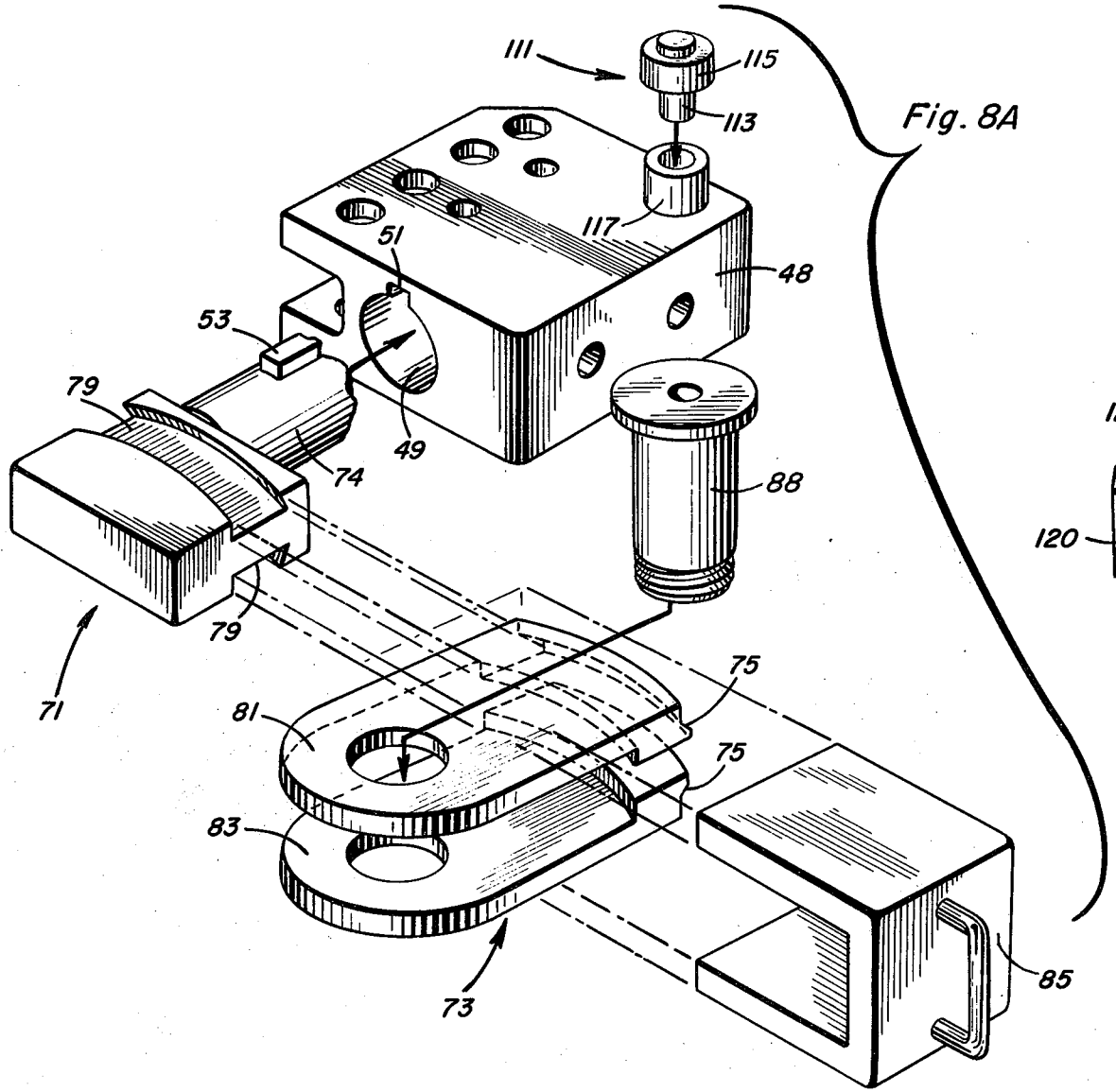
FIG. 8A is a fragmental enlarged perspective view of the preferred embodiment of the door latch.

The hook-shaped latch member 72 and corresponding latch member 90 represent the initial concept for the door latch of this invention. However, this arrangement has not proven completely satisfactory in actual practice. Accordingly, a new door assembly has been developed as illustrated in FIGS. 8A, 8B and 8C. In this preferred door assembly, latch slide 71 is rigidly attached to the end of piston rod 74 and includes recesses 79. Top member 81 and bottom member 85 of door latch 73 include projections 75 which fit into correspondingly shaped recesses 79 of latch slide 71. Top member 81 and bottom member 83 of door latch 73 are connected by spacer 85 so that projections 75 of the top and bottom members of door latch 73 are properly aligned with respect to recesses 79. Door latch 73 is pivotally mounted on door 40 by pivot pin 88 to allow door latch 73 to pivot into and out of engagement with latch slide 71. In similar manner to the embodiment illustrated in FIG. 2, door 40 can be swung away from tong body 26 about hinge pin 58.

Additionally, a projection 101 may be attached to door 40 as illustrated in FIG. 2. Projection 101 is constructed to fit into a complimentary opening in U-shaped member 103 attached to tong body 26. In utilizing such an arrangement, door 40 is prevented from swinging open until it is moved away from tong body 26 by piston and cylinder assemblies 62 and 76. This safety mechanism insures that door 40 will not swing open while the tongs are gripping the drill pipe joints. This arrangement also removes some stress from piston rods 60 and 74 caused by lateral forces exerted on these piston rods when the tongs are making up or breaking apart joints of drill pipe.

Figure 3:
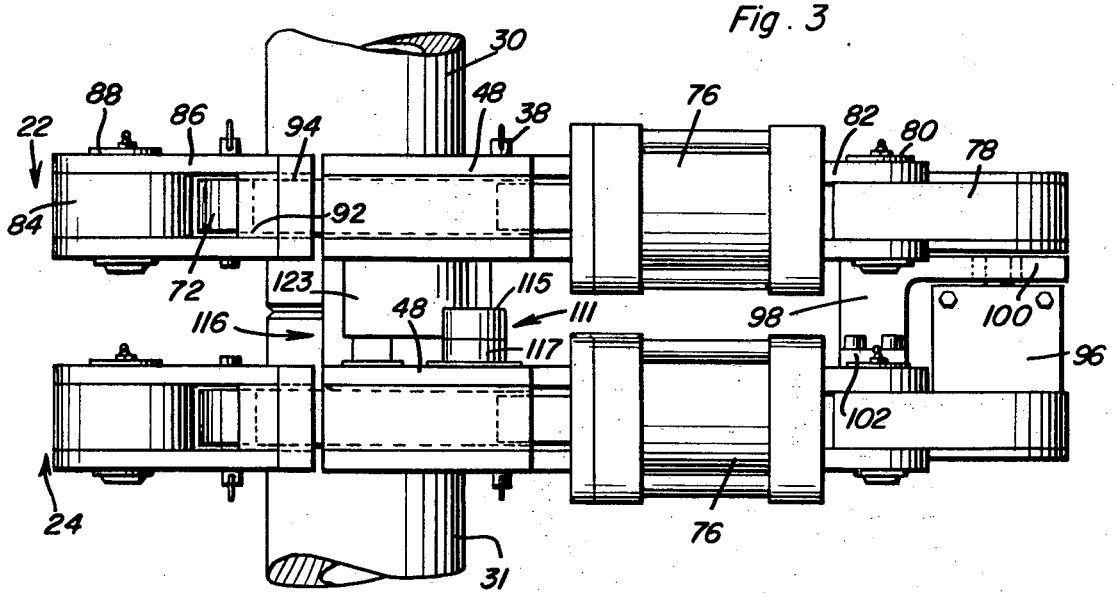
FIG. 3 is a side elevational view of the construction of FIG. 2 illustrating the association of the upper and lower tongs.

Due to the lateral forces which are exerted during the making up or breaking apart of joints of drill pipe and the like, an arrangement is provided to relieve these forces so that they do not damage piston rods 60 and 74. As illustrated in FIGS. 2, 3 and 8, roller assemblies 111 each include shaft 113 and roller 115. Shaft 113 fits into roller housing 117 which is attached to the top of each of guides 46 and 48 of lower tong 24. A projection 123 on the lower portion of each of guides 46 and 48 of upper tong 22 includes a curved surface 125 against which roller bearing 115 rides. The center of curvature of curved surface 125 corresponds to the center of rotation of tongs 22 and 24 so that the tongs can move relative to each other when making up or breaking apart pipe joints yet roller assembly 111 and curved surface 125 are maintained in contact. In this manner, lateral forces which would normally be exerted directly on piston rods 60 and 74 are transferred to the guides 46 and 48 of the tongs 22 and 24. Additionally, guides 46 and 48 include a shaft opening 49 having a keyway 51. Keys 53 are attached to pistons 60 and 74 such that keys 53 fit into keyways 51 while pistons 60 and 74 slide in shaft openings 49. In this manner, keys 53 also remove some of the lateral forces normally exerted on pistons 60 and 74 as well as providing a means for guiding the pistons in the shaft openings.

Figure 5:
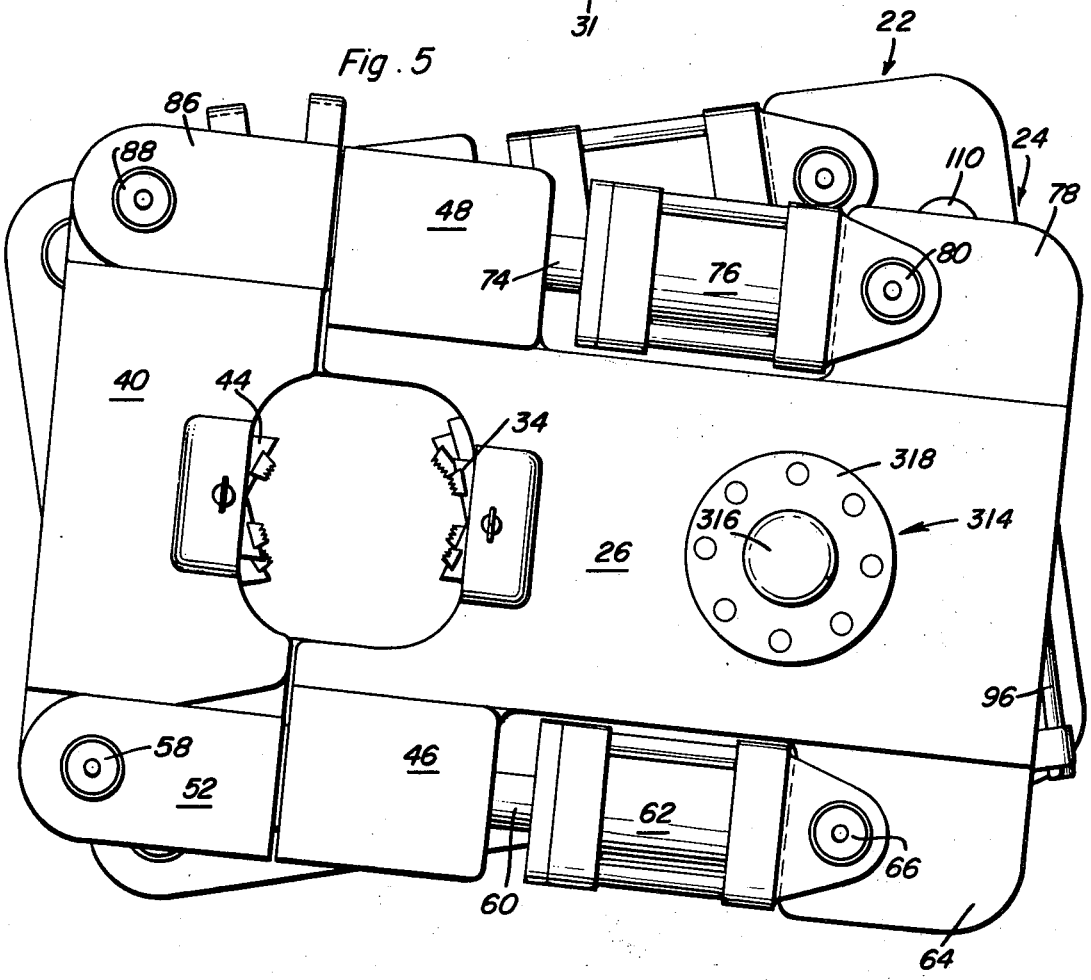
FIG. 5 is a bottom plan view of the tongs illustrating the upper and lower tongs in their torqueing position.

All of the structure defined above with respect to the upper tong 22 also applies to the lower tong 24 which grips or releases a lower drill pipe joint 31 while the upper tong 22 grips or releases an upper drill pipe joint 30. In order to swivel or rotate the upper tong 22 in relation to the lower tong 24 or move the tongs 10 to a torqueing position as illustrated in FIG. 5, double acting hydraulic piston and cylinder assembly 96 is provided adjacent the end of the tong bodies 26 remote from the die heads 34 which interconnects the upper and lower tongs 22 and 24 so that by extending and retracting the torqueing piston and cylinder assembly 96 in timed relation to extension and retraction of the piston and cylinder assemblies 62 and 76, the upper and lower drill pipe joints 30 and 31 may be torqued in a manner to make-up or break apart a drill pipe.

Figure 4:
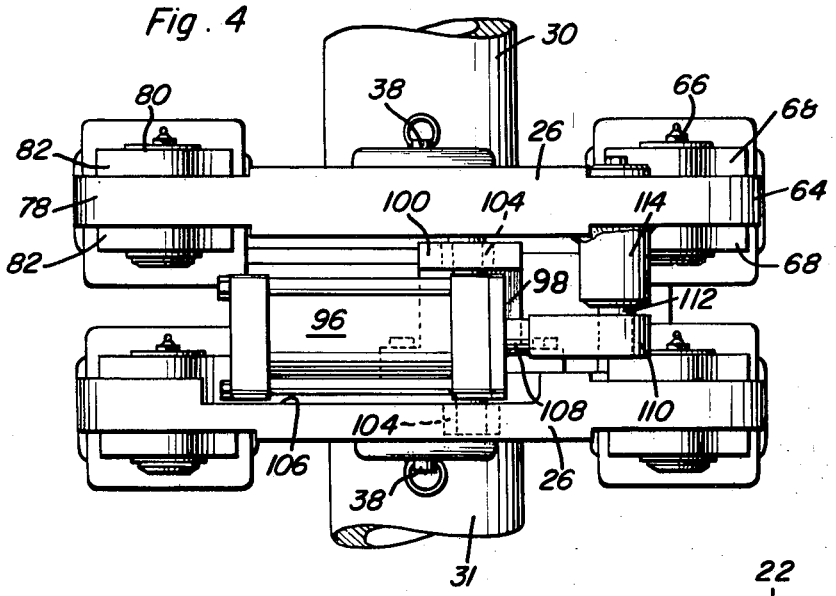
FIG. 4 is an end view of the construction of FIG. 2 illustrating the association of the torqueing piston and cylinder assembly with the upper and lower tongs.

The piston and cylinder assembly 96 is secured to the tong body 26 on the lower tong 24 by an upstanding bracket 98 having a horizontally extending plate 100 at the upper end thereof and a flange 102 at the lower end bolted to the lower tong body 24 as illustrated in FIGS. 2–4. The plate 100 and a corresponding portion of the tong body 26 on the lower tong 24 support the inner end of the piston and cylinder assembly by a bearing and pin assembly 104 in which the projecting pins are rigid with the cylinder and are received in bearings provided in the plate 100 and the lower tong body 26 as illustrated in FIG. 4. Also as illustrated in FIG. 4, the portion of the lower tong body 26 which receives the piston and cylinder assembly 96 is provided with a recess 106 in that area for partially receiving the piston and cylinder assembly so that the upper and lower tongs 22 and 24 can be oriented as close as possible.

The piston and cylinder assembly 96 includes a piston rod 108 extending therefrom provided with an adapter 110 on the end thereof which receives a depending pin 112 which extends through the projecting corner 64 on the upper tong body 26 as illustrated in FIG. 4. The portion of the upper tong body 26 which receives the pin 112 is provided with a depending rigid pin receiving sleeve 114 which is welded to the tong body 26 as illustrated in FIG. 4. Thus, with this construction, extension and retraction of the piston and cylinder assembly 96 will cause the upper and lower tongs 22 and 24 to move toward and away from the torqueing position illustrated in FIG. 5. That is, with the upper tong 22 either in alignment with the lower tong 24 or the upper tong 22 moved into angular position with respect to the lower tong 24 which is the torqueing position illustrated in FIG. 5, the tongs 22 and 24 are moved in a swivelling manner and rotate one tool joint in relation to the other. All of the pin connections may be provided with suitable retaining plates and lubrication facilities and the structural details thereof varied as desired. In addition, the pins 38 holding the die heads 34 and 44 may be readily removable pins to enable easy removal and insertion of die heads for ready interchange thereof.

Figure 6:
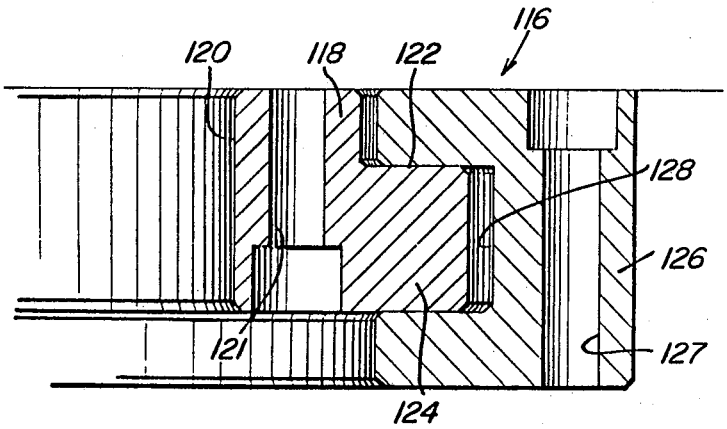
FIG. 6 is a fragmental enlarged sectional view of the swivel connection between the upper and lower tongs.
Figure 7:
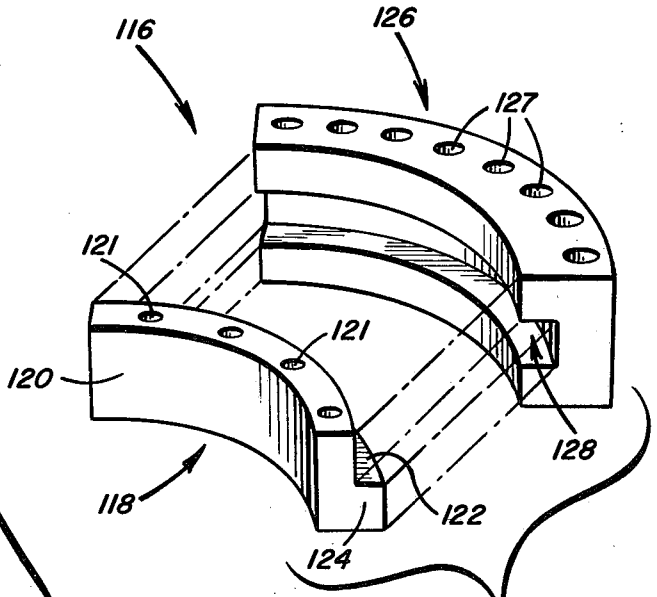
FIG. 7 is an exploded perspective view of the individual components of the swivel connection between the upper and lower tongs shown in FIG. 6.

The upper and lower tongs 22 and 24 are swivelly interconnected by a swivel ring assembly 116 as illustrated in detail in FIGS. 6 and 7 and which includes a partial inner annular ring 118 that has an inner surface 120 which forms the internal periphery of the swivel ring assembly 116 with the internal surface 120 being spaced outwardly of the die head 34 so that there will be no interference with movement of the drill pipe joints through the tongs. The inner partial ring 118 is secured to the upper tong body 26 by suitable cap screws, bolts or the like received in apertures 121 and is provided with an external shoulder 122 defined by a peripheral projection 124 at the bottom portion of the partial ring 118. An outer partial ring 126 is secured to the lower tong body 26 by suitable cap screws, bolts or the like received in apertures 127 and includes an inwardly facing channel-shaped groove or recess 128 which closely receives the projection 124 on the inner partial ring 118 insofar as vertical dimension is concerned to swivelly orient the upper and lower tongs 22 and 24 so that they will pivot about a central portion of the drill pipe joints 30 and 31 during their relative pivotal movement.

Spinner 20 tends to exert a force on drill pipe 30 when the spinner first grips the pipe thus pulling pipe 30 and upper tong 22 in the rearward direction toward pedestal 16. This causes a corresponding force to be transmitted through lower tong 24 to support member 18 and pedestal 16 which places a large stress on these support members. Accordingly, a one-quarter inch clearance is provided between inner partial ring 118 and outer partial ring 126. When pipe 30 and upper tong 22 are pulled rearward by spinner 20, this clearance is sufficient to allow inner partial ring 118 which is attached to upper tong 22 to move but allow outer partial ring 126 attached to lower tong 24 to remain substantially stationary. Therefore, there are essentially no forces exerted on support member 18 and pedestal 16 through lower tong 24.

Figure 9:
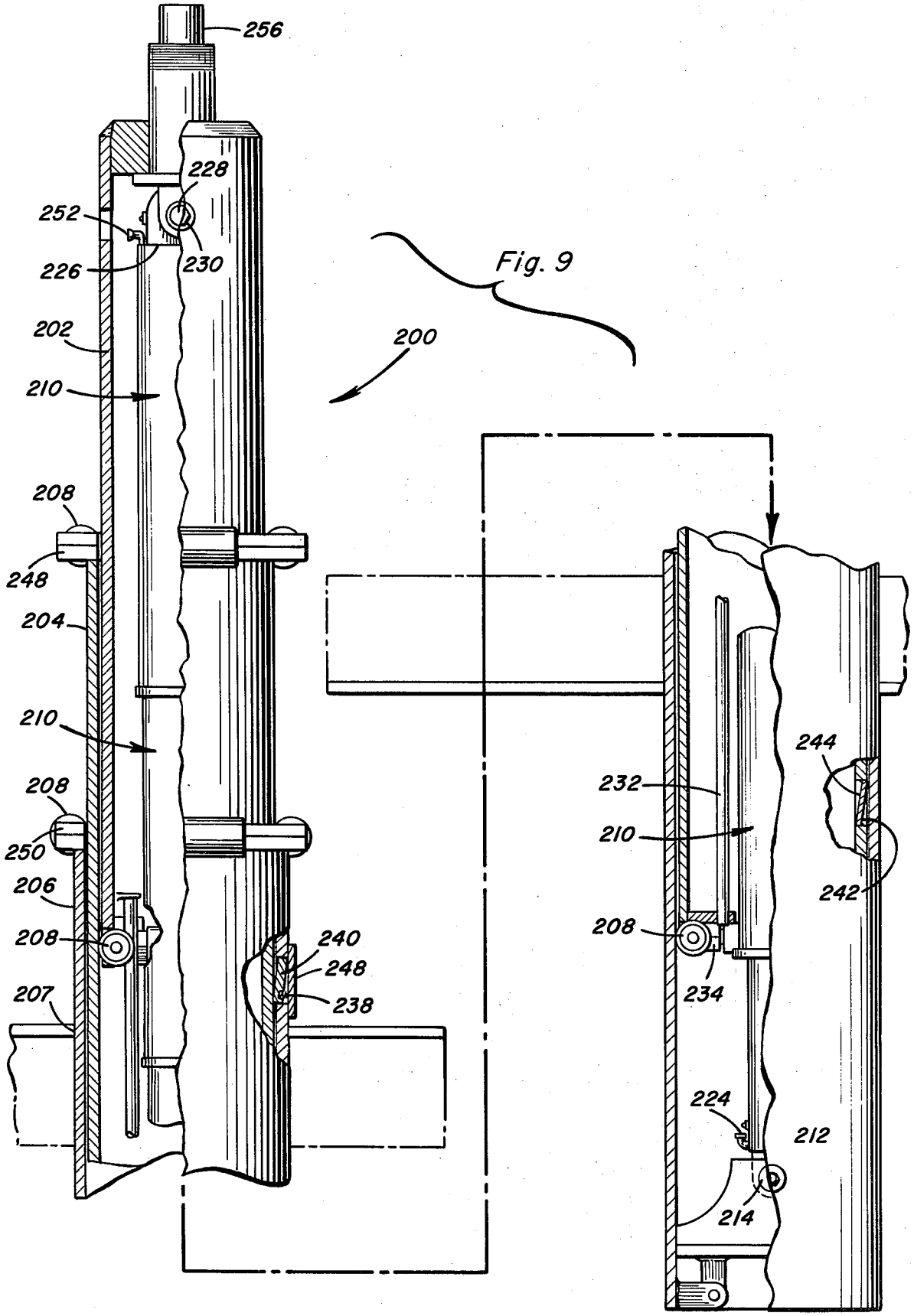
FIG. 9 is a side elevational view, partly in section, of another embodiment of the supporting pedestal.

The hydraulically operated tongs 10 may be controlled remotely with a suitable power unit supplying hydraulic fluid at a desired pressure with a control console including valves for operating the several piston and cylinder assemblies. The tongs and spinner may be vertically elevated by a suitable mechanism such as a hydraulic lift cylinder 200 or the like shown in FIGS. 9 and 10 in order to orient the upper tong 22 and lower tong 24 on the lower drill pipe or tool joint 31.

Hydraulic lift cylinder 200 includes concentric cylinders 202, 204 and 206. Cylinder 206 is fixedly mounted such as by attaching it to supporting turntable 14 or rig floor 12 as shown at 207. Cylinder 204 is mounted in cylinder 206 and longitudinally moveable relative thereto. In like manner, cylinder 202 is moveably mounted in cylinder 204. Cylinders 202, 204 and 206 have guide rollers 208 associated therewith to minimize frictional losses during vertical movement between the cylinder walls.

Figure 10:
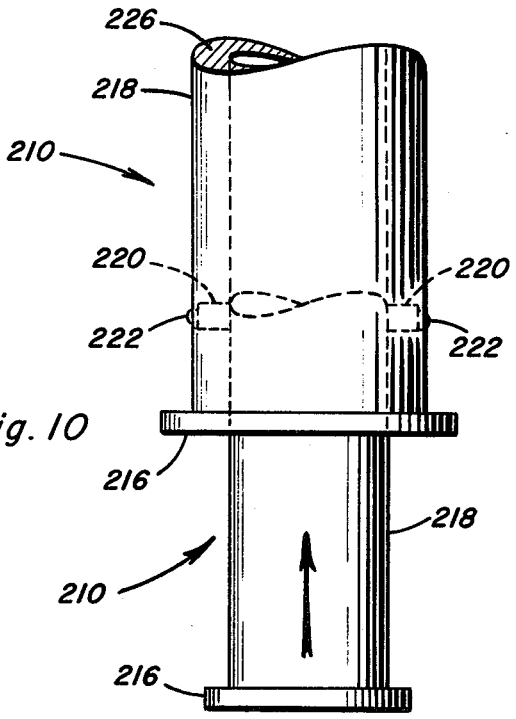
FIG. 10 is a fragmental enlarged side view of the movable sections of the supporting pedestal shown in FIG. 9.
Figure 13:
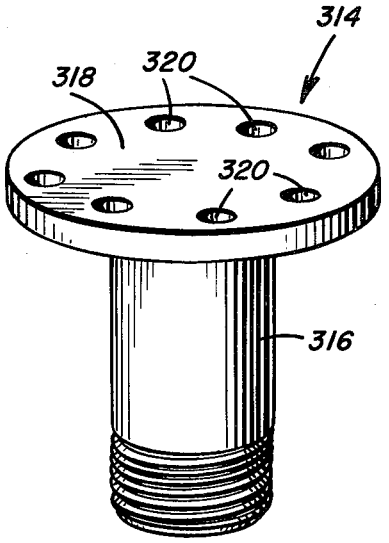
FIG. 13 is an enlarged perspective view of the tong support.

Inner cylinder 202 includes a plurality of movable sections 210 that sleeve over each other in which the lowest section 210 is attached to stationary cylinder 206 which is covered by cap 212. Uppermost section 210 is secured to the top of movable cylinder 202 by pin 228 which is covered by cap 230. Referring to FIG. 10, each section 210 includes a lower rim 216 of similar inner diameter to that of the next lowest cylindrical pipe 218. Each section 210 also includes an upper rim 220 having sliding seals 222 which seal against the inner wall 218. Bleeder valve 252 is utilized to remove any air that may have entered the hydraulic system, thus increasing the efficiency of the system.

As fluid is pumped into hydraulic lift cylinder 200 through fluid opening 224, the fluid pressure pushes against roof 226 of the uppermost cylinder section 210, thus forcing uppermost section 210 and movable cylinder 202 attached thereto to rise. Upon forcing uppermost section 210 to its fully extended position, lower rim 216 of uppermost section 210 contacts and pushes against the underside of upper rim 220 of the next lowest section 210, causing the next lowest section 210 to rise, thereby raising cylinder 202 even higher. As cylinder 202 is being raised, but before all of cylinder sections 210 are fully extended, stopping rod 232, which is welded to stopping block 234 of movable cylinder 204, contacts and is pulled up by stopping block 236 of movable cylinder 202, causing movable cylinder 204 to rise. Upon reaching a certain predetermined level, spring 238 forces latch 240 of stationary cylinder 206 into space 242 until it contacts retainer wall 244. To provide access and to provide an abutment for spring 238, access plate 246 is secured to the outside of movable cylinder 206.

To lower hydraulic lift cylinder 200, fluid is discharged from movable sections 210 through fluid opening 224, causing movable sections 210 and movable cylinders 202 and 204 to descend in the opposite order of assent. The descending motion of movable cylinder 204 is limited by the action of stopping rim 248 contacting stopping rim 250 of stationery cylinder 206. Additionally, movable cylinder 202 is limited in its descending movement by the action of stopping block 236 contacting stopping block 234 of movable cylinder 204.

Figure 11:
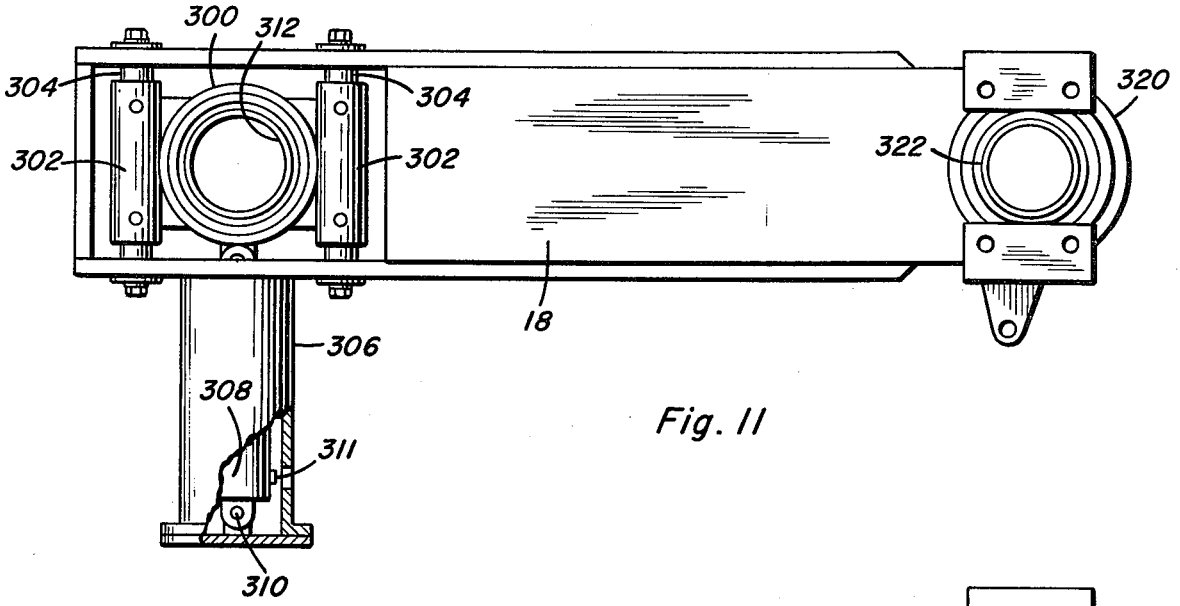
FIG. 11 is a top plane view, partly in section, of the tong support member which is attached to the supporting pedestal shown in FIG. 9.
Figure 12:
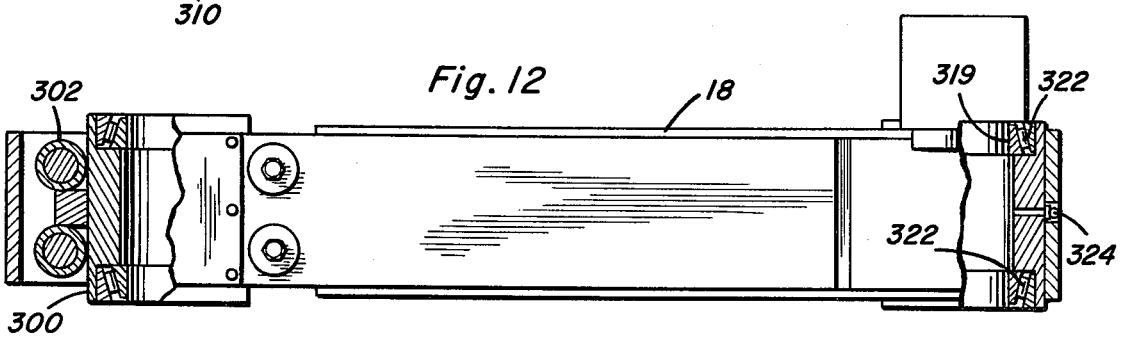
FIG. 12 is a side view, partly in section, of the tong support member shown in FIG. 11.

Referring to FIGS. 11 and 12, support member 18 includes tong attachment 300 mounted on slide housing 302. Slide housing 302 slides on pins 304 securely attached to support member 18. Cylinder housing 306 is securely attached perpendicular to support member 18 and includes double acting hydraulic cylinder 308 attached to cylinder housing 306 by cylinder mounting pin 310. Hydraulic fluid is pumped through fluid opening 311 to move the piston assembly (not shown) of hydraulic cylinder 308 and thereby cause slide housing 302 to back and forth on pins 304. By regulating the amount of hydraulic fluid pumped into the system, die head 36 is properly horizontally aligned with drill pipe joints 30 and 31.

The tong support 314 is illustrated in FIG. 12. This support includes shaft 316 and base 318. Shaft 316 is received in opening 301 in tong attachment 300. Shaft 316 is rotatable relative to tong attachment 300 and bears against bearings 312. Lower tong 24 is securely attached to tong base 318 by bolts or the like received in apertures 320. In this manner, lower tong 24 may be swivelled while making up or breaking apart a pipe joint.

In like manner, shaft 256, attached to the top of inner cylinder 202, is received in opening 319 of support attachment 320 which is securely mounted on support member 18. Support attachment 320 includes a bearing 322 similar to bearing 312. Grease insert 324 may be utilized to lubricate bearings 322. In this manner, support member 18 may be pivoted, if desired, about pedestal 16 by any conventional means (not shown).

When the tongs are properly aligned with the threaded joint, a valve is actuated for simultaneously retracting the two bottom piston and cylinder assemblies 62 and 76 for moving the lower door 40 inwardly toward the lower tong body 26 thereby gripping the lower drill pipe joint 31. Then, depending upon whether the drill pipe is being made up or broken apart, the torque piston and cylinder assembly 96 is extended or retracted. During the extension or retraction of the torque cylinder, the piston and cylinder assemblies 62 and 76 on the upper tong 22 will be in their extended positions so that the upper door 40 is remote from the upper tong body 26 and the upper tong 22 can rotate in relation to the upper drill pipe joint 40. Thus, with the upper tong 22 released and the torque piston and cylinder assembly 96 either extended or retracted to an initial position depending upon whether the drill pipe is being made up or broken out, the upper tong 22 may then be brought into gripping engagement with the upper drill pipe joint 30 by retracting the two upper piston and cylinder assemblies 62 and 76. After this has occurred, both the upper drill pipe joint 30 and the lower drill pipe joint 31 are securely gripped by the respective tongs. Then, the piston and cylinder assembly 96 is actuated for moving the upper and lower tongs 22 and 24 pivotally or swivelly in relation to each other thus torqueing the drill pipe joints 30 and 31 either in a clockwise manner or a counterclockwise manner depending upon whether the drill pipe is being made up or broken out. In either instance, the spinner is utilized to initially rotate the upper drill pipe joint 30 when making up the drill pipe with the spinner rotating the pipe rather rapidly but at a relatively low torque with the tongs 10 serving to finally tighten the drill pipe joints when making up a drill pipe. Conversely, when breaking out a drill pipe, the tongs 10 initially break apart the joints with the spinner subsequently unthreading the upper joint 30 from the lower joint 31 at a relatively high speed and low torque.

As compared with present devices which employ a centrally-positioned single hydraulic ram to change the relative position of the gripping die heads and to grip the drill pipe joints when the hydraulic ram is in its most expanded position, the present invention includes one piston and cylinder assembly attached to the hinge slide and another attached to the latch slide, with the two cylinders being timed to work together both hydraulically and mechanically to grip the pipe when the cylinders are in their most retracted position. The spaced apart cylinder pair provides for a more controlled and better supported gripping of the pipe than with a single centrally positioned cylinder not only because of the use of two spaced apart cylinders rather than one centrally positioned, but also because the cylinders are retracted during the power of gripping position. In addition, with the movable die head on the door, the door may be allowed to slide away from the body a desired distance, such as approximately four inches, which will provide ample room to permit the tool joints, protectors and the like to pass through the tongs while leaving the tongs on the pipe. Thus, by providing a pair of power cylinders, one on each side of the line of relative movement of the gripping die heads, which cylinders are in their most contracted position for gripping the pipe, the tongs can be made so that the door with the cylinders extended (in the non-power position) allows the drill pipe joints, protectors and the like to be moved through the tongs without removing the tongs from the pipe. Accordingly, the making up or breaking out of a drill pipe can be more expediently conducted with less expenditure of time and labor and with less torqueing damage to the drill pipe joints. The latch and hinge arrangement also enables the tongs to be removed from the pipe when necessary.

As stated previously, the spinner will spin the stand of pipe in or out while the tong provides the make or break torque and the pedestal and support member and associated equipment provide for the lateral and vertical position of the tong and spinner unit. The specific structure of the spinner unit and the specific control console form no particular part of the present invention with the control for the tongs including commercially available components arranged in a manner to obtain the desired performance from the tongs 10.

The foregoing is considered as illustrative only of the principles of the invention. Many modifications and changes can be made within the scope of this invention. For example, the described invention may be utilized for breaking apart or making up drill bit joints. In utilizing the invention in this manner, the die heads 34 on lower tong 24 are removed and replaced with bit breakers. The bit breakers fit over the lobes of the bit and securely hold the bit while the upper tong 22 rotates the drill pipe 30 to make up or break apart the drill bit joint. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. Power operated tongs for making up or breaking apart pipe joints comprising an upper tong and a lower tong, means swivelly connecting the upper and lower tongs for relative angular movement, each of said tongs including a pair of opposed gripping jaws disposed in facing relation for gripping engagement with an upper and lower drill pipe joint, respectively, and power operated means interconnecting the upper and lower tongs for swivelling the tongs in relation to each other over a limited displacement angle whereby the drill pipe joints may be made up or broken apart, one of the gripping jaws on each of the tongs being supported on a movable door, the opposed gripping jaw on each tong being mounted on a tong body, first means interconnecting the tong body and each end of the door to simultaneously move both ends of the door toward and away from the tong body in parallel relation to the tong body wherein each end of the door remains equidistant from the tong body for enlarging the distance between the jaws to enable the pipe joints to be moved through the tongs without disassembly of the tongs from the pipe, and second means for opening and pivoting said movable door to an open position to enable the pipe joints to be moved through the open door and placed into position between the gripping jaws or removed therefrom.

2. The power operated tongs as defined in claim 1 wherein said means swivelly connecting the upper and lower tongs includes a first partial ring secured to the upper tong body and a second partial ring secured to the lower tong body with interengaging flange means on each of the partial rings for enabling rotational movement of the tongs in relation to each other while preventing vertical movement.

3. The power operated tongs as defined in claim 2 wherein said first and second partial rings are spaced apart a predetermined distance to allow the first partial ring to move toward and away from the second partial ring.

4. The power operated tongs as defined in claim 3 wherein said predetermined distance is one quarter of an inch.

5. The power operated tongs as defined in claim 1 wherein said power operated means for swivelling the tongs includes a power operated piston and cylinder assembly including a piston pivotally attached to one of the tongs and a piston rod pivotally connected to the other of the tongs in spaced relation to the swivel connection means thereby exerting rotational torque on the tongs for relative rotational movement during extension and retraction of the piston and cylinder assembly.

6. The power operated tongs as defined in claim 1 wherein each tong body and door are of plate-like construction with notches formed in adjacent edges for receiving the gripping jaws and drill pipe joints.

7. The power operated tongs of claim 1 wherein said power operated means for swivelling the tongs and said means interconnecting the tong body and each end of the door are hydraulically operated.

8. The power operated tongs of claim 1 wherein said power operated means for swivelling the tongs and said means interconnecting the tong body and each end of the door are pneumatically operated.

9. The power operated tongs as defined in claim 1 wherein said first means interconnecting the tong body and each end of the door comprises a pair of power operated piston and cylinder assemblies mounted on each side of the tong body and connected on one side to a hinge slide pivotally connected to one end of the door and on the other side to a latch slide releasably connected to the other end of the door, said second means including a pivotal latch member connected at one end of the door to allow disengagement of one end of the door to enable the door to be swung to an open position for removal of the tongs from the drill pipe.

10. The power operated tongs as defined in claim 9 wherein said means swivelly connecting the upper and lower tongs includes a first partial ring secured to the upper tong body and a second partial ring secured to the lower tong body with interengaging flange means on each of the partial rings for enabling rotational movement of the tongs in relation to each other while preventing vertical movement.

11. The power operated tongs as defined in claim 10 wherein said power operated means for swivelling the tongs includes a power operated piston and cylinder assembly including a piston pivotally attached to one of the tongs and a piston rod pivotally connected to the other of the tongs in spaced relation to the swivel connection means thereby exerting rotational torque on the tongs for relative rotational movement during extension and retraction of the piston and cylinder assembly.

12. The power operated tong as defined in claim 11 wherein each tong body and door are of plate-like construction with notches formed in adjacent edges for receiving the gripping jaws and drill pipe joints.

13. Power operated tongs for making up or breaking apart pipe joints comprising an upper tong and a lower tong, means swivelly connecting the upper and lower tongs for relative angular movement, each of said tongs including a pair of opposed gripping jaws disposed in facing relation for gripping engagement with an upper and lower drill pipe joint, respectively, and power operated means interconnecting the upper and lower tongs for swivelling the tongs in relation to each other over a limited displacement angle whereby the drill pipe joints may be made up or broken apart, one of the gripping jaws on each of the tongs being supported on a movable door, the opposed gripping jaw on each tong being mounted on a tong body, and means interconnecting the tong body and each end of the door to simultaneously move both ends of the door toward and away from the tong body in parallel relation to the tong body for enlarging the distance between the jaws to enable the drill pipe joints to be moved through the tongs without disassembly of the tongs from the drill pipe, wherein said means interconnecting the tong body and each end of the door comprises a pair of power operated piston and cylinder assemblies mounted on each side of the tong body and connected on one side to a hinge slide pivotally connected to one end of the door and on the other side to a latch slide releasably connected to the other end of the door, said door including a pivotal hinge member connected at one end of the door, and a hooked-shaped latch member connected to the latch slide to enable disengagement of one end of the door to enable the door to be swung to an open position for removal of the tongs from the drill pipe.

14. A power operated tong for use in making up or breaking apart a threaded joint comprising a tong body having a gripping means on one edge thereof, a tong door having a gripping means on one edge thereof disposed in spaced, aligned relation to the gripping means on the tong body for selectively gripping and releasing a threaded joint disposed therebetween when the tong door is moved toward and away from the tong body, and first means interconnecting the tong body and tong door for moving the tong door toward and away from the tong body in parallel relation to the tong body for engaging and disengaging said gripping means on a threaded joint disposed therebetween, and second means for opening and pivoting one end of said tong door to an open position to enable a threaded joint to be placed into position between the gripping means or removed therefrom.

15. A power operated tong for use in making up or breaking apart a threaded joint comprising a tong body having a gripping means on one edge thereof, a tong door having a gripping means on one edge thereof disposed in spaced, aligned relation to the gripping means on the tong body for selectively gripping and releasing a threaded joint disposed therebetween when the tong door is moved toward and away from the tong body, and means for moving the tong door comprising a pair of power operated cylinders interconnecting the tong body and tong door on opposite sides of the tong door for simultaneously moving portions of the tong door on opposite sides of the gripping means toward and away from the tong body in parallel relation to the tong body with such movement enabling gripping of said member when said cylinders are contracted, wherein one end portion of the tong door is pivotally connected to the means for moving the tong door and the other end of the tong door is releasably connected to the means for moving the tong door, whereby the tong door can be disconnected and pivoted about its one end portion to an open position to enable the threaded joint to be gripped to be placed into a position between the gripping means or removed therefrom.

16. The power operated tongs as defined in claim 15 wherein said means for moving the tong door include a pair of hydraulically operated piston and cylinder assemblies interconnecting the tong body and tong door on opposite sides of the tong door, each piston and cylinder assembly including a cylinder attached to the tong body and a piston rod extending therefrom and received in a guide rigid with the tong body to mechanically retain the tong door in parallel relation to the tong body during its movement toward and away from the tong body.

17. The power operated body as defined in claim 16 wherein said means for releasably connecting the other end of the tong door to the means for moving the tong door includes a hook-shaped latch member on one of the piston rods and a pivotal latch member attached at the other end of the tong door and engageable by the hook-shaped latch member whereby the pivotal latch member may be disengaged and pivoted away from the hook-shaped latch member for releasing one end of the tong door.

18. The power operated tongs as defined in claim 16 wherein said means for releasably connecting the other end of said tong door to the means for moving the tong door includes a latch member having recesses on one of the piston rods and a pivotal latch member having projections at the other end of the tong door and engageable by the latch member wherein said pivotal latch member may be disengaged and pivoted away from said latch member for releasing one end of said tong door.

19. A power operated tong for use in making up or breaking apart a threaded joint comprising a tong body having a gripping means on one edge thereof, a tong door having a gripping means on one edge thereof disposed in spaced, aligned relation to the gripping means on the tong body for selectively gripping and releasing a threaded joint disposed therebetween, first means interconnecting said tong body and tong door for moving the tong door toward and away from the tong body in parallel relation to the tong body for engaging and disengaging said gripping means on a threaded joint therebetween, and latch and pivot means for opening and pivoting one end of said tong door to an open position to enable the threaded joint to be placed into position between the gripping means or removed therefrom.

20. The power operated tong as defined in claimed 19 wherein said first means interconnecting the tong body and the tong door includes a pair of power operated piston and cylinder assemblies mounted on each side of the tong body, and said power operated tong includes an upper tong and a lower tong, and means swivelly connecting the upper and lower tongs, said power operated tong having a roller assembly for relieving stresses from said piston and cylinder assemblies when said power operated tong is making up or breaking apart a threaded joint while allowing said upper and lower tongs to swivel in relation to each other.

21. The power operated tong as defined in claim 20 wherein said roller assembly includes a roller attached to said lower tong and a member having a curved bearing surface attached to said upper tong, the roller riding on the curved bearing surface when the tongs are swivelled.

22. The power operated tong as defined in claim 19 wherein said tong includes means for preventing said tong door from being pivotally opened while said power operated tong is gripping a threaded pipe.

23. The power operated tong as defined in claim 22 wherein said prevention means includes a projection on said tong door opposite said latch means, and a U-shaped member on said tong body opposite said latch means, said projection fitting into said U-shaped member when said tong door is closed.

24. The power operated tong as defined in claim 19 wherein said power operated tong is mounted on a support member attached to a pedestal.

25. The power operated tong as defined in claim 24 wherein said pedestal includes a hydraulic lift cylinder for vertically raising and lowering said tong.

26. The power operated tong as defined in claim 25 wherein said pedestal includes means for rotating said tong about the vertical axis of said pedestal.

27. The power operated tong as defined in claim 25 wherein said power operated tong includes means for horizontally aligning said gripping means on the tong body and said gripping means on the tong door with said member disposed therebetween.

28. The power operated tong as defined in claim 27 wherein said horizontal alignment means comprises means for moving the tong body laterally relative to the direction of movement of the tong door toward and away from said tong body.

29. A power operated tong as defined in claim 28 wherein said horizontal alignment means includes a slide housing for mounting said tong.

30. The power operated tong as defined in claim 29 wherein said horizontal alignment means includes a hydraulic cylinder attached to said slide housing.

31. A power operated tong for use in making up or breaking apart a threaded joint comprising a tong body having a gripping means on one edge thereof, a tong door having a gripping means on one edge thereof disposed in spaced, aligned relation to the gripping means on the tong body for selectively gripping and releasing a threaded joint disposed therebetween, first means interconnecting said tong body and tong door for moving the tong door toward and away from the tong body in parallel relation to the tong body for engaging and disengaging said gripping means on a threaded joint therebetween, latch and pivot means for opening and pivoting one end of said tong door to an open position to enable the threaded joint to be placed into position between the gripping means or removed therefrom and means for horizontally aligning said gripping means on the tong body and said gripping means on the tong door with said threaded joint disposed therebetween.

32. The power operated tong as defined in claim 31 wherein said means for horizontally aligning said gripping means with said threaded joint disposed therebetween includes a slide housing for mounting said tong and for moving said tong laterally in relation to the direction of movement of said tong door toward and away from said tong body.

33. The power operated tong as defined in claim 32 wherein said means for horizontally aligning said gripping means with said threaded joint disposed therebetween includes a hydraulic cylinder attached to said slide housing.

34. A power operated tong for use in making up or breaking apart a threaded joint comprising a tong body having a gripping means on one edge thereof, a tong door having a gripping means on one edge thereof disposed in spaced, aligned relation to the gripping means on the tong body for selectively gripping and releasing a threaded joint disposed therebetween, first means interconnecting said tong body and tong door for moving the tong door toward and away from the tong body in parallel relation to the tong body for engaging and disengaging said gripping means on a threaded joint therebetween, latch and pivot means for opening and pivoting one end of said tong door to an open position to enable the threaded joint to be placed into position between the gripping means or removed therefrom, and means for vertically displacing said tong in relation to said member.

35. The structure of claim 34 wherein said vertical displacement means comprises a hydraulic lift cylinder.

36. A power operated tong for use in making up or breaking apart a threaded joint comprising a tong body having a gripping means on one edge thereof, a tong door having a gripping means on one edge thereof disposed in spaced, aligned relation to the gripping means on the tong body for selectively gripping and releasing a threaded joint disposed therebetween, means for simultaneously moving both ends of the door toward and away from the tong body in parallel relation to the tong body wherein each end of the door remains equidistant from the tong body, means for swinging said door open about one end of said door pivotally attached to said tong body, means for vertically raising and lowering said power operated tong in relation to said member disposed therebetween, and means for horizontally aligning said power operated tong with said member disposed therebetween.

* * * * *